United States Patent [19]

Busi et al.

[11] 3,964,275

[45] June 22, 1976

[54] TERRY LOOP FORMING INSTRUMENT FOR CIRCULAR KNITTING MACHINE

[75] Inventors: Giovanni Busi; Pierluigi Belli, both of Brescia, Italy

[73] Assignee: Officina Meccanica Giovanni Busi, Sera (Brescia), Italy

[22] Filed: June 26, 1975

[21] Appl. No.: 590,618

[52] U.S. Cl. ..... 66/91; 66/8

[51] Int. Cl.[2] ..... D04B 35/00

[58] Field of Search ..... 66/91, 8, 90, 95, 115, 66/116, 13, 14, 92, 93, 104

[56] References Cited

UNITED STATES PATENTS

| | | | |
|---|---|---|---|
| 597,288 | 1/1898 | Ingalls et al. | 66/92 |
| 1,896,686 | 2/1933 | Ingalls | 66/95 X |
| 2,014,132 | 9/1935 | Holmes | 66/95 X |
| 3,110,167 | 11/1963 | Parthum | 66/95 |
| 3,477,255 | 11/1969 | Lombardi | 66/91 |
| 3,726,112 | 4/1973 | Rogue | 66/95 |

*Primary Examiner*—Ronald Feldbaum
*Attorney, Agent, or Firm*—Bell, Seltzer, Park & Gibson

[57] ABSTRACT

The terry loop forming instruments are positioned in vertically extending slots in the needle cylinder and between the slots containing the cylinder needles. The terry loop forming instruments are supported for vertical sliding movement in the slots and cams are provided at the knitting station for raising and maintaining the terry loop instruments at a relatively high level as the cylinder needles are lowered to form terry loops from a terry yarn and to form body yarn stitch loops of a body yarn. The terry loop forming instruments are adapted for use with a circular hosiery knitting machine having at least one knitting station and being adapted to knit socks and the like.

4 Claims, 5 Drawing Figures

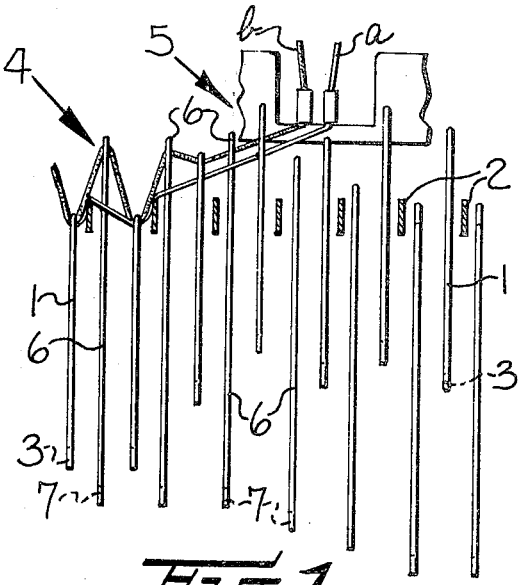
Fig-1
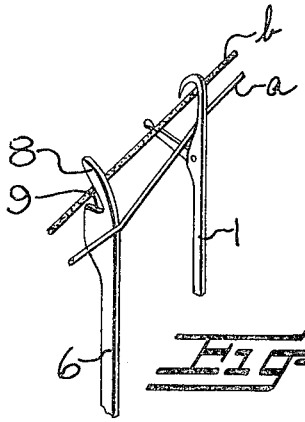
Fig-5
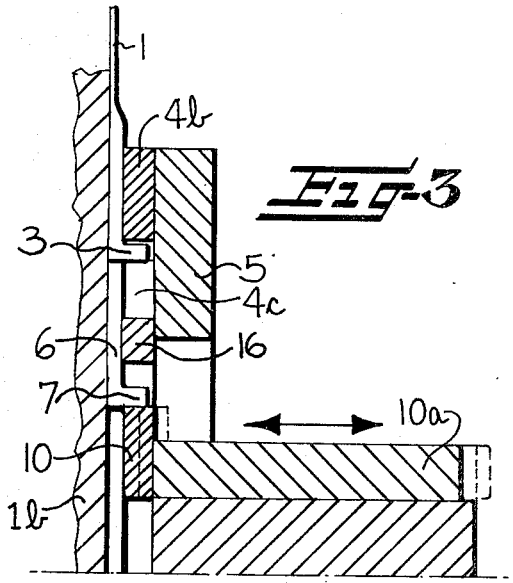
Fig-3
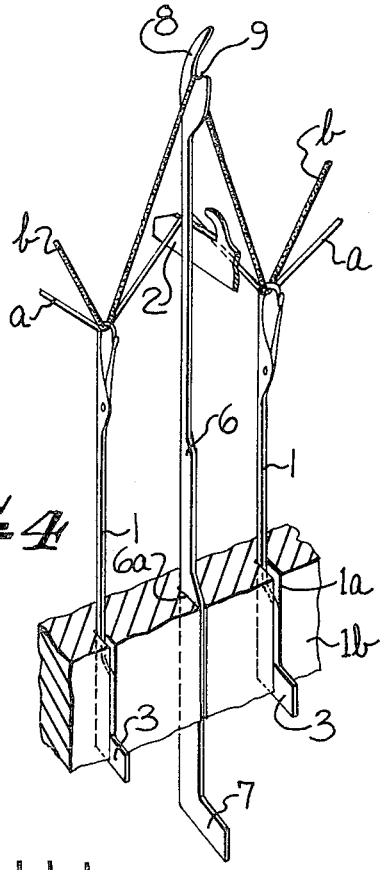
Fig-4
Fig-2
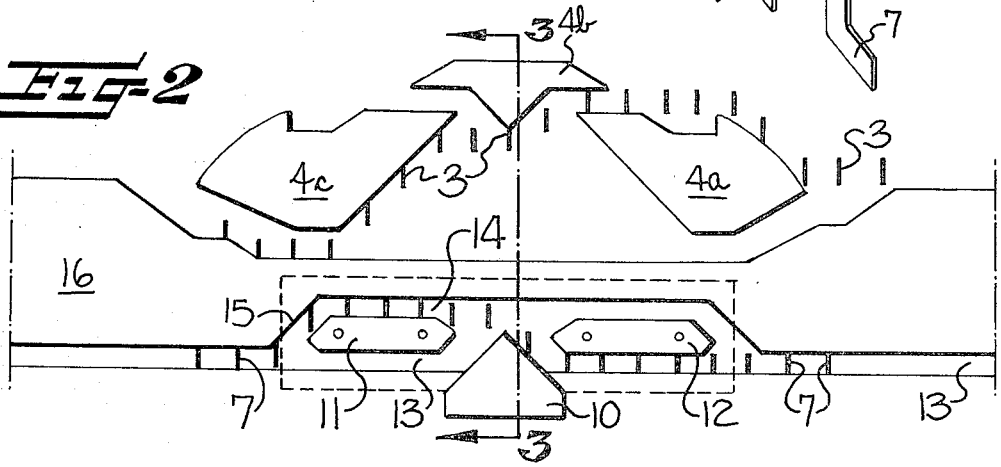

TERRY LOOP FORMING INSTRUMENT FOR CIRCULAR KNITTING MACHINE

This invention relates generally to terry loop forming instruments for circular hosiery knitting machines and more particularly to terry loop forming instruments which may be operated to form terry stitches with either continuous rotation or reciprocation of the needle cylinder, such as is carried out in the knitting of socks with the continuous rotation being employed in the knitting of the foot and leg and reciprocation being employed in the knitting of heel and/or toe pockets.

The usual method of forming terry loops on hosiery machines includes feeding two yarns at the knitting station to form stitch loops of both yarns on the cylinder needles while one yarn is fed in the normal throat of the sinkers while the other yarn is fed on top of the neb of the sinkers to form terry loops in the sinker wales and which extend outwardly from the inside of the tubular fabric. However, this method of forming terry loops requires a wide separation of the terry yarn and the body yarn at the knitting station in order to insure that the nebs of the sinkers are properly positioned between the yarns. This separation of the yarns can present difficulty, particularly during reciprocation when knitting a heel pocket. Also, this known method presents problems when it is desired to selectively knit terry loops in certain areas only of the sock and it is difficult to change the size of length of the terry loops being formed.

With the foregoing in mind, it is an object of the present invention to provide terry loop forming instruments for forming terry loops in selected portions of socks and which does not require the wide separation of the terry and body yarns at the yarn feeding station.

In accordance with the present invention, the terry loop forming instruments are positioned in vertically extending slots between the cylinder needles and cams are provided at the knitting station for raising and maintaining the terry loop instruments at a relatively high level as the cylinder needles are lowered to form terry loops of the terry yarn and to form body yarn stitch loops of both the terry and body yarn in plated relationship. Each of the terry loop instruments comprises a terry jack including a butt extending outwardly from the lower end and beyond the outer periphery of the needle cylinder with a beak curving upwardly and outwardly from the inner surface of the terry jack and being substantially pointed at its upper end. A horizontal flat or throat extends from the lower end of the beak and outwardly to the outer surface of the terry jack. The terry yarn is engaged by the throat and maintained at a relatively high level while the body yarn is guided down the curved beak of the terry jack and moves down inside of the terry jacks so that it forms normal size loops in the sinker wales. The terry jack cams at the knitting station are selectively operable for engagement with the butts of the terry jacks so that the terry jacks are at times raised by the cams to form terry loops and at other times remain in a lowered position so that terry loops are not formed. The terry cams include a radially movable terry jack raising cam having an upwardly extending triangular cam surface for engagement by the butts of the terry jacks when the needle cylinder swings in either direction and a pair of terry jack control cams positioned on opposite sides of the terry jack raising cam for further raising the terry jacks and for maintaining them in the raised position while the cylinder needles are lowered by the stitch cams.

Other objects and advantages will appear as the description proceeds when taken in connection with the accompanying drawings, in which:

FIG. 1 is a partial development view of the machine, looking outwardly from inside of the needle cylinder, and showing the arrangement of needles and terry jacks as they pass the yarn feeding station;

FIG. 2 is a partial development view of some of the cams surrounding the needle cylinder and showing the stitch cams for moving the cylinder needles through stitch forming motions and the cams for operating the terry jacks at the knitting station;

FIG. 3 is a vertical sectional view taken substantially along the line 3—3 in FIG. 2;

FIG. 4 is a somewhat schematic fragmentary isometric view looking in the direction of the arrow 4 in FIG. 1 and looking from the outside of the needle cylinder; and FIG. 5 is a fragmentary isometric view looking in the direction of the arrow 5 in FIG. 1, looking from the inside of the needle cylinder, and illustrating the manner in which the terry yarn and body yarn are separated by the terry jack.

The hosiery knitting machine includes the usual latch needles 1 which are supported for vertical sliding movement in slots 1*a* cut in the needle cylinder 1*b*. The cylinder needles 1 cooperate with sinkers 2 in the usual manner for forming stitch loops and the sinkers 2 are supported for radial sliding movement between the needles and in the usual sinker bed, not shown. The needles 1 are provided with operating butts 3 which extend outwardly beyond the slots in the needle cylinder 1*b* and cooperate with stitch cams at a knitting station for moving the needles 1 through stitch forming motions.

The stitch cams include a right-hand stitch cam 4*a*, a center cam 4*b* and a left-hand stitch cam 4*c* which are suitably supported on a bracket 5 (FIG. 3) for engagement by the operating butts 3 of the cylinder needles 1 as the needle cylinder swings in either direction. In FIG. 2 the path of travel of the butts 3 is illustrated as the needle cylinder continuously rotates in a counterclockwise direction so that the butts 3 are raised by the right-hand switch cam 4*a*, partially lowered by the center cam 4*b* and then lowered to stitch forming position by the left-hand stitch cam 4*c*. When the needle cylinder swings in the opposite direction, the butts 3 of the needles 1 pass over the left-hand stitch cam 4*c* and then beneath the right-hand stitch cam 4*a*. As is well known, the needle cylinder continuously rotates during the knitting of the leg and foot portions of a sock while it reciprocates during the knitting of the heel and/or toe pocket.

First and second yarn feed guides (FIG. 1) are provided at the knitting station for respectively feeding a terry yarn *b* (shown speckled in the drawings) and a body yarn *a* into the hooks of the cylinder needles 1 as they pass the knitting station. In accordance with the present invention, terry loop forming instruments in the form of terry jacks 6 are supported for vertical sliding movement in slots 6*a* (FIG. 4) in the needle cylinder 1*b* and between the cylinder needles 1. Each terry jack 6 includes a butt 7 extending outwardly from the lower end and beyond the outer periphery of the needle cylinder 1*b* and a beak 8 at the upper end thereof. The beak 8 curves upwardly and outwardly from the inner surface of the terry jack 6 and is substantially pointed at its upper end. A horizontal flat or throat 9 extends horizontally from the lower end of the beak 8 and outwardly to the outer surface of the terry jack for engagement by the terry yarn *b*, in a manner to be presently described.

Terry jack cam means is provided at the knitting station for raising and maintaining the terry jacks 6 at a relatively high level as the cylinder needles 1 are lowered to form stitch loops of both yarns and to form terry loops of the terry yarn. The terry jack cam means includes a radially movable terry jack raising cam 10 having an upwardly extending triangular cam surface for engagement by the butts 7 of the terry jacks 6 when the needle cylinder moves in either direction and when the cam 10 is moved to its innermost position. The cam 10 is fixed on the inner end of a slide bar 10*a* which may be positioned in three positions, indicated in dotted lines in FIG. 3. In the innermost position, shown in FIG. 3, the cam 10 will engage the butts 7 of all of the terry jacks 6. When positioned in an intermediate position, the cam 10 will only engage and raise the terry jacks 6 which have long butts 7 thereon. When positioned in the outermost position, the cam 10 will not engage any of the butts 7 and will not raise any of the terry jacks 6. The terry jack cam means also includes a pair of terry jack control cams 11, 12 (FIG. 2) positioned on opposite sides of the terry jack raising cam 10 and being engageable by the butts 7 of the terry jacks 6 which have been initially raised by the cam 10. These terry jack control cams 11, 12 further raise the terry jacks 6 and maintain them in raised position while the cylinder needles 1 are lowered by the stitch cams.

METHOD OF OPERATION

In accordance wth the present invention, terry loops are formed on the terry loop forming instruments or jacks 6 while the terry yarn *b* and the body yarn *a* are fed to the needles 1 at the knitting station (FIG. 1). The needles 1 are raised by the right-hand stitch cam 4*a* and then lowered by the center cam 4*b* and the left-hand stitch cam 4*c* to pick up both the terry yarn *b* and the body yarn *a* in the hooks thereof (FIG. 5) and form stitch loops of both yarns in plated relationship in the needle wales of the fabric. At the same time, the terry jacks 6 are raised at the knitting station as their butts 7, moving along a lower pathway 13, are engaged and are raised by the cam 10 and are further raised and maintained at a relatively high level, along the pathway 14, by the cam 11. As the terry jacks 6 are raised by the cam 10, the upper beak 8 raises up and separates the terry yarn *b* and the body yarn *a* so that the terry yarn *b* is deposited on the throat 9 while the body yarn *a* moves down the outer suface of the jack 6, as illustrated in FIG. 5.

As the needles 1 on opposite sides of the jack 6 are lowered to stitch forming position, the terry yarn *b* is maintained at a relatively high level (FIGS. 1 and 4) by the throat 9 of the jack 6 while the body yarn *a* is supported on the normal throat of the sinker 2 to form terry loops in the sinker wales between each of the needle wales. When the stitch loops have been formed by the needles 1, the terry jacks 6 are lowered as their butts engage the inclined surface 15 (FIG. 2) of the fixed cam 16. When the needle cylinder is reciprocated, the butts 7 of the terry jacks 6 first engage the cam 10 and are then further raised by the cam 12 so that the terry jacks 6 maintain the terry yarn *b* at a higher level to form terry loops.

It is preferred that one-half of the cylinder be provided with terry jacks 6 which have long butts 7 thereon while the other half of the cylinder is provided with terry jacks 6 which have short butts 7 thereon. When it is desired to make terry loops on the entire inner surface of the sock, the cam 10 will be moved completely in against the cylinder in order to raise all of the terry jacks 6. In cases where it is desired to knit terry loops on selected portions of the cylinder only, such as one-half of the lower part of the foot to form a cushion sole, or in the heel and/or toe, the cam 10 will be moved to the intermediate position so that only terry jacks 6 having the long butts engage the cam 10 and are raised to form terry loops thereon.

It is preferred that the cam means for raising the terry jacks 6 be vertically adjustable so that the terry jacks 6 may be to different heights, relative to the needles 1 and sinkers 2, to thereby change the size or length of the terry loops formed by the jacks 6. Thus, the terry loop forming instruments of the present invention provide a convenient means for forming terry loops in selected portions of a sock and for easily varying the size of the terry loop formed.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a circular hosiery knitting machine including a needle cylinder adapted for rotation and reciprocation, spaced apart vertically extending slots in said needle cylinder for slideably receiving needles therein, and a knitting station including stitch cams for moving said cylinder needles through stitch forming motions and first and second yarn feed guides at said knitting station for respectively feeding terry yarn and body yarn to said cylinder needles, the combination therewith of terry loop forming instruments positioned between said cylinder needles, vertically extending slots in said needle cylinder between said cylinder needles for slideably supporting said terry loop forming instruments, and cam means supported at said knitting station for raising and maintaining said terry loop instruments at a predetermined level as said cylinder needles are lowered to form stitch loops of both yarns and to form terry loops of the terry yarn.

2. In a circular hosiery knitting machine according to claim 1 wherein said terry loop forming instruments each comprise a terry jack including a butt extending outwardly from the lower end and beyond the outer periphery of said needle cylinder, a beak curving upwardly and outwardly from the inner surface of said terry jack and being substantially pointed at its upper end, and a throat extending horizontally from the lower end of said beak and outwardly to the outer surface of said terry jack for engagement by the terry yarn.

3. In a circular knitting machine according to claim 2 wherein said cam means is selectively operable for engagement with said butts of said terry jacks so that said terry jacks are at times raised by said cam means to form terry loops and at other times remain in a lowered position so that terry loops are not formed.

4. In a circular hosiery knitting machine according to claim 3 wherein said cam means includes a radially movable terry jack raising cam having an upwardly extending triangular cam surface for engagement by said butts of said terry jack when said needle cylinder swings in either direction, and a pair of terry jack control cams positioned on opposite sides of said terry jack raising cam and being engageable by said butts of said terry jacks for further raising said terry jacks when initially raised by said terry jack raising cam and for maintaining said terry jacks in raised position while said cylinder needles are lowered by said stitch cams.

* * * * *